US009176511B1

(12) United States Patent
Dang et al.

(10) Patent No.: US 9,176,511 B1
(45) Date of Patent: Nov. 3, 2015

(54) BAND-GAP CURRENT REPEATER

(71) Applicant: QUALCOMM Incorporated, San Diego, CA (US)

(72) Inventors: Nam Van Dang, San Diego, CA (US); Rajeev Jain, San Diego, CA (US); Terrence Brian Remple, San Diego, CA (US); Jingcheng Zhuang, San Diego, CA (US); Mong Chit Wong, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 13 days.

(21) Appl. No.: 14/254,279

(22) Filed: Apr. 16, 2014

(51) Int. Cl.
*G05F 1/10* (2006.01)
*G05F 1/46* (2006.01)

(52) U.S. Cl.
CPC ..... *G05F 1/468* (2013.01)

(58) Field of Classification Search
CPC ..... G05F 1/577; G05F 1/59; G05F 1/595; G05F 3/26; G05F 3/262
See application file for complete search history.

(56) References Cited

U.S. PATENT DOCUMENTS

| | | | | |
|---|---|---|---|---|
| 5,373,253 | A * | 12/1994 | Bailey et al. | 330/288 |
| 6,894,556 | B2 | 5/2005 | Kawasumi | |
| 6,914,475 | B2 | 7/2005 | Enriquez et al. | |
| 8,441,149 | B2 | 5/2013 | Trivedi et al. | |
| 8,710,915 | B2 * | 4/2014 | Ibuka | 327/543 |
| 2004/0207379 | A1 | 10/2004 | Camara et al. | |
| 2009/0261905 | A1 | 10/2009 | Ishiguro | |
| 2010/0188140 | A1 | 7/2010 | Smeloy | |
| 2013/0307517 | A1 | 11/2013 | Huang | |
| 2014/0225662 | A1 * | 8/2014 | Nishi | 327/539 |

OTHER PUBLICATIONS

International Search Report and Written Opinion—PCT/US2015/020014—ISA/EPO—May 18, 2015.

* cited by examiner

*Primary Examiner* — Jeffrey Zweizig
(74) *Attorney, Agent, or Firm* — Haynes and Boone, LLP

(57) ABSTRACT

A series of current repeaters with localized feedback is provided. Each current that precedes a subsequent current repeater in the series is configured to receive a feedback current from the subsequent current repeater and generate an error signal accordingly with a differential amplifier so as to reduce current repetition errors that would otherwise result from an offset voltage in the differential amplifier.

20 Claims, 4 Drawing Sheets

BAND-GAP CURRENT REPEATER

TECHNICAL FIELD

This application relates to repeaters, and more particularly to a band-gap current repeater.

BACKGROUND

A system-on-a-chip (SoC) typically includes a number of different circuit blocks. For example, an SoC might include a SERDES, a phase-locked loop (PLL), an analog-to-digital converter (ADC), and so on. Such circuit blocks often require their own band-gap circuit to provide a band-gap reference signal that is independent of process, voltage, and temperature (PVT) variations. But providing a band-gap reference circuit for each circuit block is costly because each band-gap reference circuit demands its own off-chip resistor, die space, and power.

To save power and reduce costs, an alternative approach is to distribute the band-gap reference signal to circuit blocks from a common band-gap reference circuit. For example, in an open-loop architecture without repeaters, a band-gap reference circuit that is shared by a group of circuit blocks distributes its band-gap reference signal to the circuit blocks through corresponding traces or leads. But such an approach is plainly unsatisfactory for precise distribution of the band-gap reference signal since the amplitude of the band-gap reference signal received by each circuit block will vary depending upon the resistive loss in the corresponding lead. Due to this loss, those circuit blocks farther away on the die from the band-gap reference circuit will receive a weaker band-gap reference signal in contrast to those circuit blocks that are closer on the die to the common band-gap reference circuit. An open-loop architecture in which the band-gap reference current is distributed through a series of repeaters addresses this resistive loss in amplitude. In the series of current repeaters, the reference current is successively repeated from current repeater to subsequent current repeater. But each repeater introduces some level of error that then propagates down through the subsequent repeaters in the series. For example, if each repeater in a series of five repeaters introduces an error of 5% in its repeated band-gap reference signal, the repeated band-gap reference signal from the fifth and final repeater in the series may have an error of 27% from the original band-gap reference signal that was distributed from the common band-gap reference signal to the first repeater in the series.

To address the error that would otherwise build-up in a series of repeaters, it is known to feedback the repeated band-gap reference signal from the final repeater in a series of current repeaters to the band-gap current source that drives the band-gap reference current to a first current repeater in the series. The band-gap current source may then adjust the band-gap reference current responsive to the feedback so that the error at the final repeater is minimized. Such a feedback scheme may be denoted as a global feedback in that the feedback from the final current repeater applies to all the repeaters in the series. But this use of global feedback does not control the local error at the various repeaters in the series prior to the final current repeater. For example, it may be that the error is unacceptably high for current repeaters in the middle of the series despite the error for the final current repeater being controlled through the global feedback to the band-gap reference circuit.

There is thus a need in the art for improved band-gap reference signal distribution architectures.

SUMMARY

A series of current repeaters is provided with localized feedback. The series extends from an initial current repeater to a final current repeater. Each current repeater prior to the final current repeater and subsequent to the initial current repeater may be deemed to reside between a previous current repeater and a subsequent current repeater in the series. For example, consider a series of five current repeaters extending from a first current repeater through a final fifth current repeater. A second current repeater in such a series is the previous current repeater with respect to a third current repeater in the series but it is the subsequent current repeater with respect to the first current repeater. Similarly, the third current repeater is the previous current repeater with respect to the fourth current repeater but it is the subsequent current repeater with respect to the second current repeater. It will thus be appreciated that the designations of "previous current repeater" and "subsequent current repeater" are relative terms with respect to any given current repeater between the initial and final current repeaters that depend upon where the given current repeater is located in the series.

The initial current repeater is of course not subsequent to a previous current repeater in the series. Similarly, the final current repeater is not a previous current repeater to any other current repeater. Because of their starting or final position, the initial and final current repeaters have different behaviors than the other current repeaters in the series. However, as will be explained further herein, all the current repeaters in the series may have a generic construction so as to increase circuit simplicity and reduce cost. But because of their different functions, the following discussion will assume that the term "current repeater" without further limitation refers to an intermediate current repeater in the series that lies between the initial and final current repeaters.

Given these definitions, each current repeater may be deemed to receive a forwarded reference current from its previous current repeater in the series and to duplicate the local forwarded reference current into another forwarded reference current driven to its subsequent current repeater in the series. Similarly, each current repeater duplicates the forwarded reference current it receives from its previous current repeater into a feedback reference current that is driven back to this previous current repeater.

Each current repeater duplicates the forwarded reference current it receives from its previous current repeater in the series into an internal reference current. Based upon its internal reference current and its feedback reference current, each current repeater generates an error signal from a differential amplifier that has an offset voltage. Each current repeater includes a current source that generates the forwarded reference current driven to its subsequent current repeater. To have accurate current repetition in each current repeater, this forwarded reference current driven to its subsequent current repeater should be an accurate duplicate of the forwarded reference current received from its previous current repeater. However, the offset voltage and a finite gain for current repeater's differential amplifier will tend to introduce undesirable errors into this current duplication. As will be explained further herein, each current repeater advantageously generates its error signal in such a fashion so as to sharply reduce the effects of the offset voltage and finite gain. The localized feedback in each current repeater thus provides for accurate current repetition throughout the series. These and other advantages may be better appreciated by the following detailed discussion.

DETAILED DESCRIPTION

Figure 1:
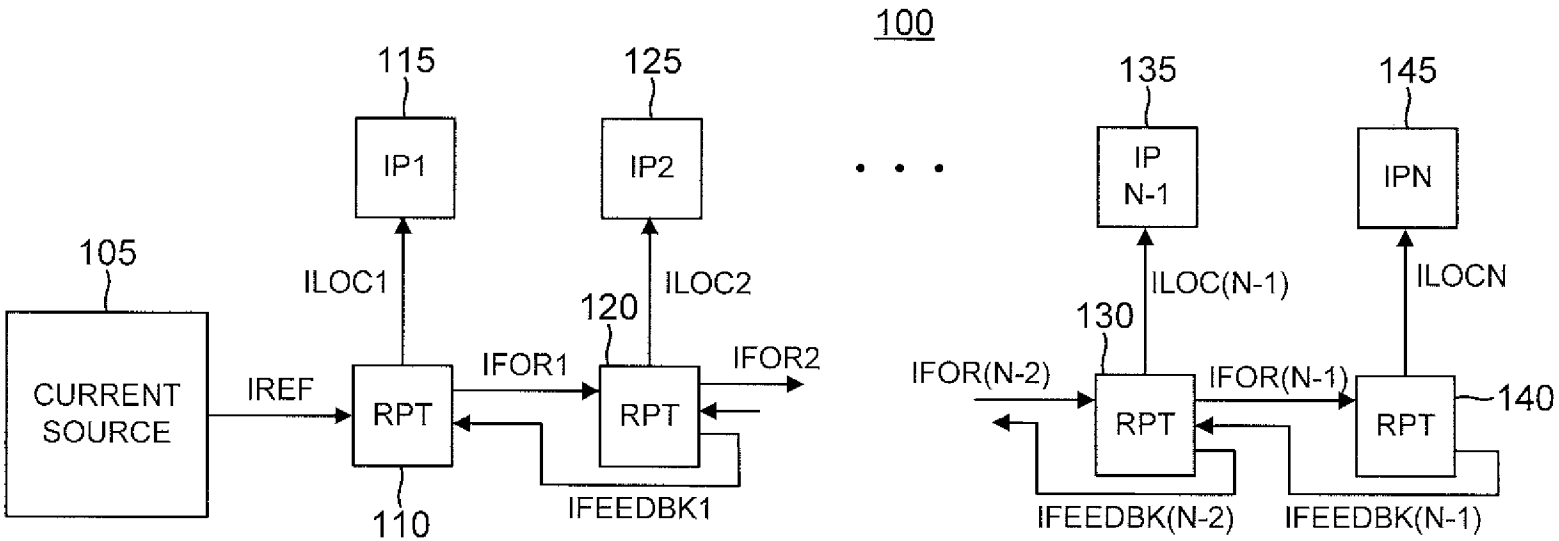
FIG. 1 is a block diagram for a series of current repeaters having localized feedback in accordance with an embodiment of the disclosure.

To provide an accurate current reference despite repetition through a series of current repeaters, a localized feedback architecture is used. In contrast to the global feedback scheme discussed above, localized feedback means that each current repeater in the series of current repeaters generates its own feedback current. An example series 100 of current repeaters with localized feedback is shown in FIG. 1. Series 100 extends from an initial or first current repeater 110 to a final or last current repeater 140. In general, there are a total of N current repeaters in series 100 (N being an integer greater than two). Final current repeater 140 is thus the Nth current repeater in series 100.

With the exception of initial current repeater 110 and final current repeater 140, each current repeater in series 100 lies between a previous current repeater and a subsequent current repeater. For example, a second current repeater 120 in series 100 is the subsequent current repeater to initial current repeater 110 but would be the previous current repeater to a third current repeater (not illustrated) in series 100. Similarly, the third current repeater would be the subsequent current repeater second current repeater 120 but would be the previous current repeater to a fourth current repeater (not illustrated). An (N−1)th current repeater 130 is the next-to-last current repeater in series 100. The functions of second current repeater 120 through next-to-last current repeater 130 are all analogous. Each of these current repeater lies between a previous current repeater and a subsequent current repeater. One can thus generically refer to an "ith" current repeater, which i is an integer from 2 to (N−1) for series 100.

Each ith current repeater receives a forwarded reference current from its previous current repeater that it then duplicates into a local forwarded reference current, a local reference current, and a local feedback current. The local feedback current is driven to the previous current repeater whereas the local forwarded reference current is driven to the subsequent current repeater. The local reference current is driven to a local circuit configured to need a reference current such as a SERDES, a phase-locked loop (PLL), an analog-to-digital converter (ADC), and so on. Each ith current repeater thus receives at least two currents: a feedback current from the subsequent current repeater (in this case, an (i+1)th current repeater) and a forwarded reference current from a previous (i−1)th current repeater. Similarly, each ith current repeater generates at least three currents: a reference current, a local forwarded reference current, and a local feedback current.

Initial current repeater 110 differs in that it has no subsequent current repeater to receive its local feedback current. Similarly, the final (Nth) current repeater 140 has no subsequent current repeater that can receive its local forwarded reference current. In contrast, an ith current repeater (i again being an integer ranging from two to (N−1)) will have both a subsequent and previous current repeater. For example, (N−1)th current repeater can send its local feedback reference current IFEEDBK(N−2) to a previous current repeater, which in this case would be an (N−2)th current repeater (not illustrated). Similarly, (N−1)th current repeater 130 can send its local forwarded reference current IFOR(N−1) to its subsequent current repeater, which in this case would be the final (Nth) current repeater 140. However, to ease design simplicity and costs, each current repeater in series 100 may have a generic construction. For example, initial current repeater 110 may include a current source to generate a local feedback current but simply disable its function or shunt such a current to ground. In alternative embodiments, however, customized embodiments may be used for initial current repeater 110 and final current repeater 140.

With these concepts in mind, the function for the various current repeaters in series 100 will now be discussed in more detail. A reference current source 105 drives a reference current IREF to first current repeater (RPT) 110. A convenient embodiment for reference current source 105 is a band-gap current circuit but it will be appreciated that other types of current sources may provide a reference current that is repeated in series 100. First current repeater 110 repeats the reference current TREF into a first local reference current (ILOC1) and a first local forwarded reference current (IFOR1). First current repeater 110 drives ILOC1 to a first local circuit 115 and drives first forwarded reference current IFOR1 to a second current repeater 120 in series 100. As discussed above, the duplicated reference currents such as first local reference current ILOC1 may be used by a wide variety of circuits such as a SERDES, a PLL, an ADC, and so on. First local circuit 115 may comprise any such circuit that requires the use of a reference current. Since first local circuit 115 is generic to any number of circuits that use a reference current, it will also be denoted herein as an intellectual property block (IP1) 115.

As will be explained further herein, first current repeater 110 may generate the repeated currents using a plurality of current sources (not illustrated in FIG. 1). For example, a first current source in first current repeater 110 may generate first local reference current ILOC1 whereas a second current source may generate first forwarded reference current IFOR1. First current repeater 110 may include additional current sources to generate additional local currents for additional IP blocks (not illustrated). Moreover, first current repeater 110 may include a biasing circuit (not illustrated) driven by the reference current IREF to generate a bias signal that controls the current source generating ILOC1 so that ILOC1 is a relatively accurate copy of the reference current IREF1. The current source generating first forwarded reference current IFOR1 is controlled by a feedback circuit as discussed further below. The various current sources in first current repeater 110 may all be matched to each other to aid in the accurate duplication of the reference current IREF.

Due to real-world inaccuracies such as process, voltage, and temperature variations across the die, even matched current sources in first current repeater 110 will not generate perfect copies of the reference current IREF. For example, first forwarded reference current TREF1 will typically not be a perfect replica of the reference current IREF. As used herein, when a current is said to be "duplicated," it will be understood to include these real-world inaccuracies. To minimize these inevitable inaccuracies, each subsequent current repeater such as second current repeater 120 in series 100 drives a feedback current back to its previous current repeater.

Analogous to first current repeater 110, second current repeater 120 includes a plurality of current sources (not illustrated) controlled by a bias signal from a bias circuit (not illustrated) that is driven by the first forwarded reference current IFOR1. One current source in second current repeater 120 duplicates first forward reference current IFOR1 into a second local reference current (ILOC2) received by a second IP block 125. Another current source in second current repeater 120 repeats first forwarded reference current IFOR1 into a first local feedback current IFEEDBK1. The feedback circuit in first current repeater 110 receives feedback current IFEEDBK1 and compares IFEEDBK1 to a repeated version of its reference current IREF to generate an error signal. This error signal controls the current source in first current repeater 110 that produces the first forwarded local reference IFOR1. Such localized feedback in each current repeater in series 100 allows each current repeater to accurately forward a repeated version of the reference current TREF to a subsequent current repeater in series 100.

Series 100 includes a plurality N of current repeaters. For illustration clarity, only the first two current repeaters 110 and 120 are shown as well as final Nth current repeater 140 and next-to-last (N−1)th current repeater 130. With the exception of first current repeater 110, each successive current repeater in series 100 receives a forwarded reference current from a previous current repeater and drives a feedback current to the previous current repeater. In addition, all current repeaters except final current repeater 140 drive a forwarded reference current to a subsequent current repeater in series 100. In that regard, note that a generic structure may be shared by each current repeater. First current repeater 110 may thus have the circuitry for generating a feedback current but simply does not use this circuitry since it is the first repeater in series 100. Similarly, final current repeater 110 may be able to generate a forwarded reference current but does not because it is the final repeater in series 100.

Analogous to second current repeater 120, next-to-last current repeater 130 duplicates or repeats an (N−2)th forwarded reference current IFOR(N−2) from a previous (N−2)th current repeater (not illustrated) in series 100 into an (N−1)th local reference current ILOC(N−1) received by an (N−1)th IP block 135. Similarly, next-to-last current repeater 130 duplicates reference current IFOR(N−2) into an (N−2)th local feedback current IFEEDBK(N−2) that is driven to the subsequent (N−2)th current repeater.

All current repeaters in series 100 that generate a local forwarded reference current to a subsequent current repeater generate the forwarded reference current responsive to an error signal representing a difference between the forwarded reference current to the subsequent current repeater and a feedback current from the subsequent current repeater. Thus, the next-to-last (N−1)th current repeater 130 forms an (N−1)th forwarded reference current IFOR(N−1) that is driven to the last current repeater 140 in this fashion.

The last current repeater 140 need not perform the error signal generation but may have the means to do so if each current repeater shares a generic structure. It is convenient and eases design complexity to have such a generic structure so the following discussion will be directed to a generic current repeater embodiment without loss of generality in that specialized first and last current repeaters could also be implemented in alternative embodiments. Last current repeater 140 need only repeat the forwarded reference current IFOR(N−1) into an nth local current ILOCN for an Nth IP block 145. Similarly, last current repeater 140 duplicates or repeats the forwarded reference current IFOR(N−1) into an (N−1)th feedback current IFEEDBK(N−1) that is fed back to the (N−1)th current repeater 130.

Figure 2:
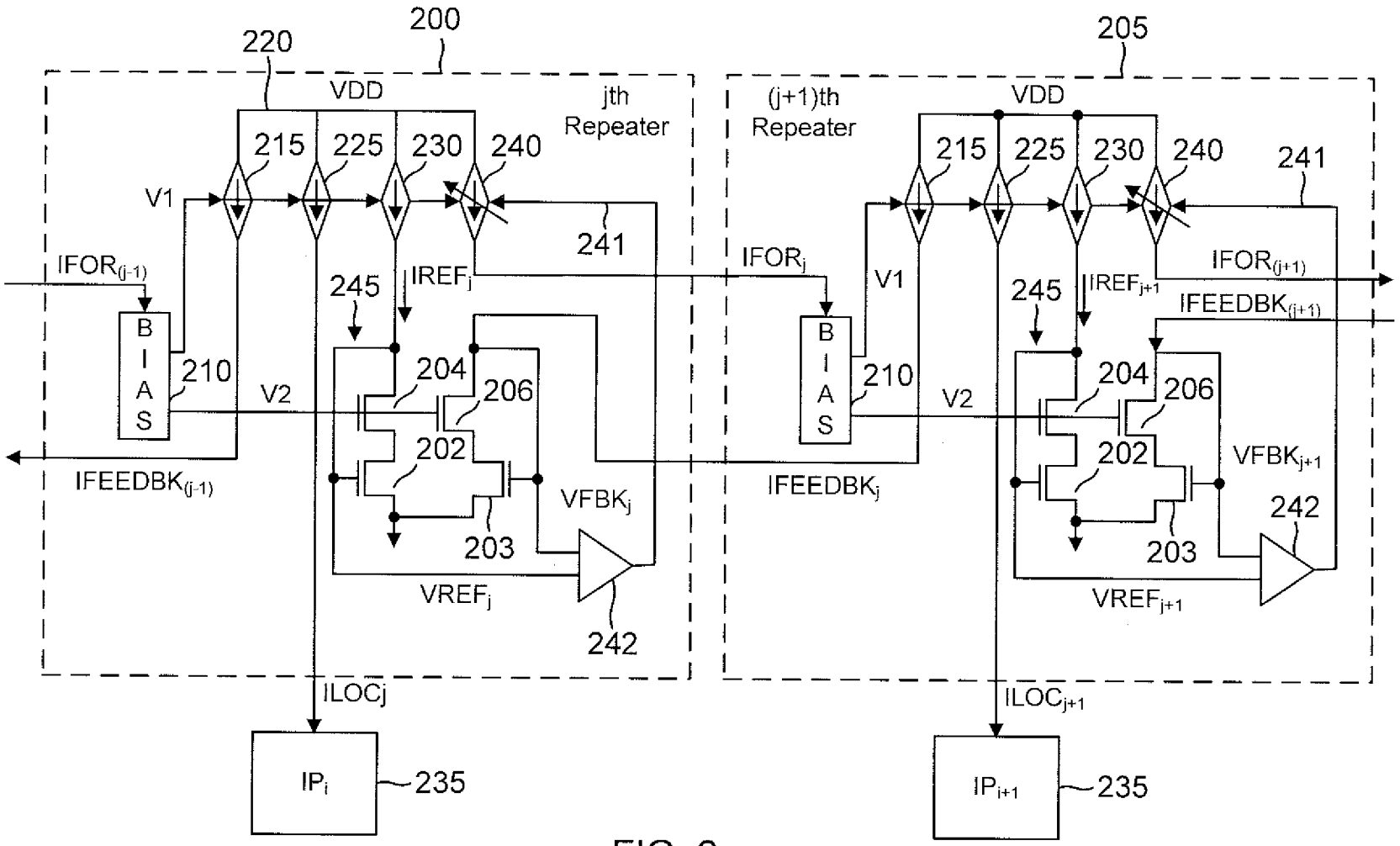
FIG. 2 is a circuit diagram for two repeaters in the series of FIG. 1.

The generic repeater structure for two consecutive current repeaters is shown in more detail in FIG. 2. A jth current repeater 200 is the jth consecutive repeater in a series of such repeaters, where j is an integer greater than one. Since j is greater than one, jth current repeater 200 feedbacks back an (j−1)th feedback current to a previous current repeater (not illustrated) that would be the (j−1)th current repeater in the series containing jth current repeater 200. If jth current repeater 200 were the first current repeater in a series of such generic current repeaters, this feedback current could instead be shunted to ground or disabled in some fashion. The (j−1)th current repeater drives an (j−1)th forwarded reference current IFOR(j−1) to jth current repeater 200. Similarly, jth current repeater 200 forwards an jth forwarded reference current IFORj to a subsequent (j+1)th current repeater 205 in the series. Similarly, (j+1)th current repeater 205 forwards a (j+1)th reference current IFOR(j+1) to its subsequent current repeater (not illustrated) in the series. Should (j+1)th current repeater instead be the final current repeater in the series, reference current IFOR(j+1) could instead be shunted to ground or disabled.

To duplicate the forwarded reference current IFOR(j−1), jth current repeater 200 receives forwarded reference current IFOR(j−1) in a bias circuit 210. Bias circuit 210 generates a bias signal such as a bias voltage V1 to control a current source 215 that duplicates forwarded reference current IFOR(j−1) into local feedback current IFEEDBK(j−1). Such duplication or repetition of a current is well-known in the repeater arts so that the circuit details within bias circuit 210 will not be explained further herein. Current source 215 may comprise, for example, a transistor such as a PMOS transistor (not illustrated) powered by a power supply node 220 providing a power supply voltage VDD. Bias voltage V1 also controls other current sources such as a current source 225 and a current source 230. Current sources 225 and 230 may be matched to current source 215. Current source 225 duplicates the forwarded reference current IFOR(j−1) into an jth local reference current ILOCj that drives a jth IP block 235. Another current source 240 generates local forwarded reference current IFORj responsive to an error signal 241 from a differential amplifier 242 in an error signal generator 245. Analogous to current source 215, current sources 230 and 225 may also each comprise a transistor such as a PMOS transistor powered by power supply node 220 providing power supply voltage VDD and having their gates controlled by bias voltage V1.

Error signal generator 245 includes a pair of differential transistors such as NMOS transistors 202 and 203. Current source 230 duplicates forwarded reference current IFOR(j−1) into an internal jth reference current IREFj that is driven through NMOS transistor 202 to generate a reference voltage VREFj at its gate. In contrast, a jth feedback current IFEEDBKj from subsequent current repeater 205 drives through NMOS transistor 203 to generate a feedback voltage VFBKj at its gate. Ideally, differential amplifier 242 functions to keep feedback voltage VFBKj equal to reference voltage VREFj. The sources of NMOS transistors 202 and 203 are tied to ground such that each transistor then has the same gate-to-source voltage, ensuring that feedback current IFEEDBCKj equals internal reference current IREFj. In turn, such equality makes the local forwarded reference current IFORj equal to the forwarded reference current IFOR(j−1), which is of course desirable. But as will be explained further herein, an offset voltage in differential amplifier 242 does not allow this ideal behavior such that the local forwarded reference current IFORj is not exactly equal to the forwarded reference current IFOR(j−1).

Error signal generator 245 may include a pair of cascode transistors such as NMOS transistors 204 and 206. Cascode transistor 204 has its source coupled to the drain of transistor 202 and its drain driven by current source 230. Similarly, cascode transistor 206 has its source coupled to the drain of transistor 203 and its drain driven by IFEEDBKj. Bias circuit 210 drives the gates of cascode transistors 204 and 206 with a second vias voltage V2.

Due to the generic construction for current repeaters 200 and 205, (j+1)th current repeater 205 has the same elements as discussed with regard to jth current repeater 200. For example, current repeater 205 includes current sources 215, 225, 230, and 240, error signal generator 242, and so on. Although the localized feedback enabled by current repeaters such as current repeater 200 and 205 is quite advantageous, note that differential amplifier 242 will inherently have some finite voltage offset with regard to its input voltages. For example, differential amplifier 242 in current repeater 200 should be in equipoise if feedback voltage VFBKj equals reference voltage VREFj. In general, a differential amplifier such as amplifier 242 has high gain such that if one of the input voltages is slightly higher than the other, it will swing its output voltage either high or low depending upon which input voltage is the higher one. But due to an internal offset voltage, differential amplifier 242 will bias error signal 241 towards either the power supply voltage VDD or ground despite the input voltages being equal. This offset voltage error combined with the finite gain from any real-world amplifier means that forwarded reference current IFORj will not equal feedback voltage IFEEDBKj despite the used of localized feedback. As a result, errors could propagate through a series of such current repeaters and successively build to undesirable levels.

Figure 3:
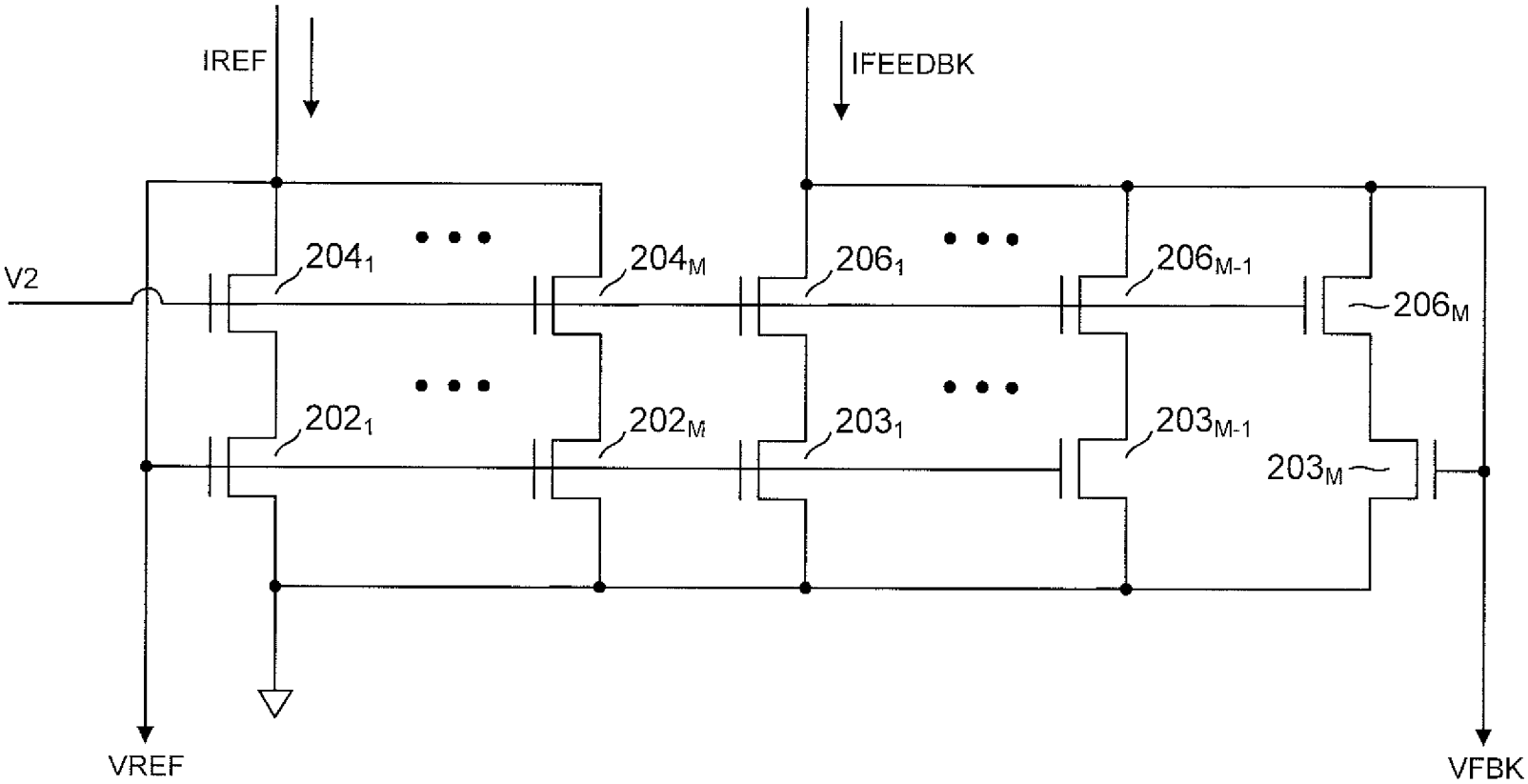
FIG. 3 is a circuit diagram for a portion of the error signal generator in either of the repeaters of FIG. 2

To counter the offset voltage and finite gain in differential amplifier 242, the differential pair of transistor 202 and 203 as well as their corresponding cascode transistors 204 and 206 may be configured as shown in FIG. 3. Each transistor comprise a parallel arrangement of M matched transistors. For example, transistor 202 comprises M transistors, ranging from a first transistor 202 to an Mth transistor $\mathbf{202}_M$. Their sources all couple in parallel to ground. Similarly cascade transistor 204 comprises M transistors, ranging from a first cascode transistor $\mathbf{204}_1$ to an Mth cascode transistor $\mathbf{204}_M$. Each cascode transistor 204 has it drain couple in parallel to current source 230 (not shown in FIG. 3) so as to share the reference current TREF. The sources of the cascode transistors 204 couple to the drain of the corresponding transistor 202. For example, the source of cascode transistor $\mathbf{204}_1$ couples to the drain of transistor $\mathbf{202}_1$, and so on. The gates of transistors 202 all couple to the drains of cascode transistors 204. Given this parallel arrangement, reference current IREF is divided equally through transistors 202 (as well as their corresponding cascode transistors 204)

Cascode transistor 206 also comprises a parallel arrangement of M transistors, ranging from a first transistor $\mathbf{206}_1$ to an Mth transistor $\mathbf{206}_M$. The drains for cascode transistors 206 are all coupled together to receive feedback current IFEEDBK in parallel and have their gates driven by the second bias voltage V2. Transistor 203 similarly comprises a parallel arrangement of M transistors ranging from a first transistor $\mathbf{203}_1$ to an Mth transistor $\mathbf{203}_M$. The sources of transistors 203 all couple together to ground. But the gates for transistors 203 are not coupled similarly. Instead, a subset of transistors 203 have their gates coupled to the drains of cascode transistors 206. In contrast, a majority of transistors 203 have their gates coupled to the drains of cascode transistors 204 and thus are driven by the reference voltage VREF. In one embodiment, transistor $\mathbf{203}_1$ to an (M−1)th transistor $\mathbf{203}_{M-1}$ may all have their gates coupled to the drains of cascode transistors 204. For example, if M equals 64 such an embodiment would then have only one transistor $\mathbf{204}_M$ that has its gate producing the feedback voltage VFBK. The remaining sixty-three transistors 203 would instead have their gates driven by the reference voltage VREF.

The resulting feedback control is quite advantageous as the errors from the offset voltage are reduced by the subset-to-majority ratio for transistors 203. In that regard, suppose the unknown error term from the voltage offset in differential amplifier 242 in either of current repeaters 200 and 205 of FIG. 2 is represented by a variable X. If the differential pair of transistors 202 and 203 are balanced as shown in FIG. 2 (all transistors 203 having their gates ties to the feedback voltage VFBK), then the error X is fully expressed in the resulting difference between local forwarded reference current IFOR and the feedback current IFEEDBK. In contrast, the error term would be just X/64 in an embodiment as shown in FIG. 3 with M equaling 64. The error term is thus reduced by nearly two orders of magnitude.

This reduction results from the feedback through the differential amplifier controlling only transistor $\mathbf{203}_M$ whereas the reference current IREF controls the remaining transistors $\mathbf{203}_1$ through $\mathbf{203}_{M-1}$. Note that transistors $\mathbf{202}_1$ through $\mathbf{202}_M$ all have the same gate-to-source feedback voltage, namely the reference voltage VREF. These transistors will thus each conduct 1/Mth of the reference current IREF. In turn, transistors $\mathbf{203}_1$ through $\mathbf{203}_{M-1}$ also have this same gate-to-source voltage equaling the reference voltage VREF. Since these transistors are matched to transistors $\mathbf{202}_1$ through $\mathbf{202}_M$, transistors $\mathbf{203}_1$ through $\mathbf{203}_{M-1}$ will each conduct a current equaling 1/Mth of the reference current IREF. That means that the remaining portion of the feedback current IFEEDBK that will flow into transistor 203M is the feedback current IFEEDBK minus ((M−1/M)*IREF). Given that the reference current IREF and the feedback current IFEEDBK are (in the ideal case) equal to each other, the current flowing through transistor $\mathbf{203}_M$ approximately equals 1/Mth of the reference current IREF. The bulk of the feedback current IFEEDBK is thus flowing through transistor $\mathbf{203}_1$ through $\mathbf{203}_{M-1}$ and is therefore not under feedback control. It is only the approximately 1/Mth portion of the feedback current IFEEDBK flowing through transistor $\mathbf{203}_M$ that responds to the feedback from differential amplifier 242. The offset voltage error from the differential amplifier thus affects just a relatively small amount of the feedback current IFEEDBK.

Referring again to FIG. 2, current source 240 may comprise a transistor such as PMOS transistor having its gate controlled by bias voltage V1. This transistor is matched to the corresponding transistors in current sources 225, 230, and 215. Inevitable mismatches between the transistors means that the forwarded current IFORj is not exactly equal to the other repeated currents such as the local current ILOCj. To accommodate this error, current source 240 may also comprise an additional transistor such as a PMOS transistor having its gate controlled by the error signal 241. This additional transistor can then "tune" the forwarded current IFORj with whatever additional amount of current is necessary as determined by differential amplifier 242 in comparing the reference voltage VREF to the feedback voltage VFBKj. In that regard this adjusted portion of the forwarded current IFORj is only subject to l/Mth of the error that would otherwise result if all transistors 203 contributed to the production of the feedback voltage as discussed above.

Since the error term from each differential amplifier 242 is thus effectively eliminated, the design requirements for the differential amplifier may be loosened accordingly such that less expensive (having fewer transistors and demanding less die area) differential amplifiers 242 may be used. The result is that current repetition is achieved much more accurately than the prior art techniques discussed above yet this achievement may use relatively simple and thus less expensive circuits.

Figure 4:
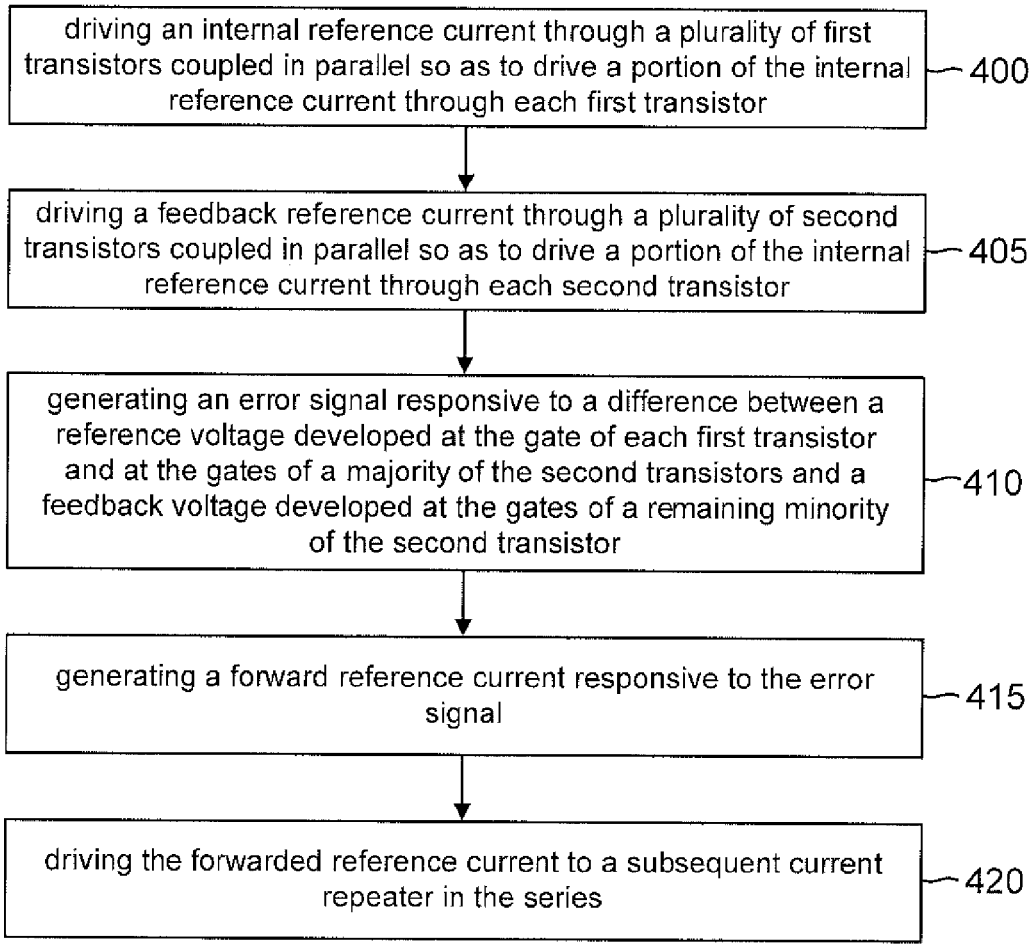
FIG. 4 is a flowchart for an example method of operation for a current repeater in the series of FIG. 1.

In one embodiment, transistors 202, 203, 204, and 206 may be deemed to comprise a means for generating the reference voltage VREF and the feedback voltage VFBK so as to reduce an effect of the offset voltage in differential amplifier 242 on a difference between the forwarded reference current IFOR and the received feedback current IFEEDBK. An example method of operation will now be discussed FIG. 4 is a flowchart for an example method of current repetition for a current repeater in a series of current repeaters in accordance with an embodiment of the disclosure. A first step 400 comprises driving an internal reference current through a plurality of first transistors coupled in parallel so as to drive a portion of the internal reference current through each first transistor. Internal reference current IREF driving through transistors 202 is an example of such a step. The method also includes a step 405 of driving a feedback reference current through a plurality of second transistors coupled in parallel so as to drive a portion of the feedback reference current through each second transistor. Feedback reference current IFEEDBK being shared by transistors 203 is an example of such a step.

The method also includes a step 410 of generating an error signal responsive to a difference between a reference voltage developed at the gates of each first transistor and at the gates of a majority of the second transistors and a feedback voltage developed at the gates of a remaining minority of the second transistors. Differential amplifier 242 generating error signal 241 is an example of such a step. In addition, the method includes an act 415 of generating a forwarded reference current responsive to the error signal. Current source 240 generating the forwarded reference current IFOR is an example of such an act. Finally, the method includes an act 420 of driving the forwarded reference current to a subsequent current repeater in the series such as also performed by current source 240.

As those of some skill in this art will by now appreciate and depending on the particular application at hand, many modifications, substitutions and variations can be made in and to the materials, apparatus, configurations and methods of use of the devices of the present disclosure without departing from the spirit and scope thereof. In light of this, the scope of the present disclosure should not be limited to that of the particular embodiments illustrated and described herein, as they are merely by way of some examples thereof, but rather, should be fully commensurate with that of the claims appended hereafter and their functional equivalents.

What is claimed is:

1. A current repeater in a series of current repeaters, comprising:

a plurality of first transistors coupled in parallel to share an internal reference current so as to generate a reference voltage at the gates of the first transistors;

a plurality of second transistors coupled in parallel to share a feedback reference current from a successive current repeater in the series, wherein the reference voltage is coupled to the gates of the first transistors and to the gates for a majority of the second transistors, and wherein the gates of a remainder of the second transistors are configured to generate a feedback voltage;

an error amplifier configured to compare the reference voltage to the feedback voltage to generate an error signal; and a first current source configured to drive a forwarded reference current to the successive current repeater responsive to the error signal.

2. The current repeater of claim 1, further comprising:

a bias circuit configured to generate a first bias voltage responsive to a received reference current from a previous current repeater in the series; and a second current source configured to generate a local reference current responsive to the first bias voltage such that the local reference current is a duplicate of the received reference current.

3. The current repeater of claim 2, further comprising:

a third current source configured to generate the internal reference current responsive to the first bias voltage such that the internal reference current is a duplicate of the received reference current.

4. The current repeater of claim 3, further comprising a plurality of first cascode transistors corresponding to the plurality of first transistors, and wherein each first cascode transistor is in series with the corresponding first transistor and is coupled to the third current source.

5. The current repeater of claim 4, further comprising a plurality of second cascade transistors corresponding to the plurality of second transistors, and wherein each second cascade transistor is in series with the corresponding second transistor and is coupled to a node carrying the feedback reference current.

6. The current repeater of claim 5, wherein the bias circuit is further configured to generate a second bias voltage responsive to the received reference current, and wherein the gates of the first cascode transistors and the gates of the second cascode transistors are all coupled to the second bias voltage.

7. The current repeater of claim 6, wherein the gates of the first transistors are coupled to the drains for the first cascode transistors, and wherein the gates of the remainder of the second transistors are coupled to the drains of the second cascode transistors.

8. The current repeater of claim 3, further comprising:

a fourth current source configured to drive a local feedback reference current to the previous current repeater in the series responsive to the first bias voltage, wherein the local feedback reference current is a duplicate of the received reference current.

9. The current repeater of claim 1, wherein the first current source comprises a PMOS transistor.

10. The current repeater of claim 2, further comprising a local circuit configured to receive the local reference current, wherein the local circuit is selected from the group consisting of a SERDES, a phase-locked loop (PLL), and an analog-to-digital converter (ADC).

11. A method for a current repeater in a series of current repeaters, comprising:

driving an internal reference current to a plurality of first transistors coupled in parallel so as to drive a portion of the internal reference current through each first transistor;

driving a feedback reference current from a subsequent current repeater in the series to a plurality of second transistors coupled in parallel so as to drive a portion of the feedback reference current through each second transistor;

generating an error signal responsive to a difference between a reference voltage developed at the gates of each first transistor and at the gates of a majority of the second transistors and a feedback voltage developed at the gates of a remaining minority of the second transistors;

generating a forwarded reference current responsive to the error signal; and driving the forwarded reference current to a subsequent current repeater in the series.

12. The method of claim 11, further comprising:

receiving a local forwarded reference current from a previous current repeater in the series; and duplicating the received local forwarded reference current to form the internal reference current.

13. The method of claim 11, wherein generating the error signal comprises amplifying the difference in a differential amplifier.

14. The method of claim 12, further comprising:

duplicating the local forwarded reference current to form a local reference current; and driving the local reference current to a local circuit configured to receive the local reference current.

15. The method of claim 11, wherein driving the internal reference current to the plurality of first transistors further comprises driving the internal reference current to a plurality of first cascode transistors so as to drive a portion of the internal reference current through each first cascode transistor.

16. The method of claim 15, wherein driving the feedback reference current to the plurality of second transistors further comprises driving the feedback reference current to a plurality of second cascode transistors so as to drive a portion of the feedback reference current through each second cascode transistor.

17. A current repeater in a series of current repeaters, comprising;

a first current source configured to generate a forwarded reference current for a subsequent current repeater in the series responsive to an error signal;

a differential amplifier configured to amplify a difference between a reference voltage and a feedback voltage to generate the error signal, the differential amplifier having an offset voltage; and means for generating the reference voltage and the feedback voltage so as to reduce an effect of the offset voltage on a difference between the forwarded reference current and a received reference current from a previous current repeater in the series.

18. The current repeater of claim 17, further comprising:

a second current source configured to duplicate the received reference current into a local reference current; and a local circuit configured to receive the local reference current.

19. The current repeater of claim 18, wherein the local circuit is selected from the group consisting of a SERDES, a phase-locked loop (PLL), and an analog-to-digital converter (ADC).

20. The current repeater of claim 18, further comprising:

a third current source configured to duplicate the received reference current into a local feedback current and to drive the local feedback current to the previous current repeater in the series.

* * * * *